US009695671B2

(12) United States Patent
Myhre et al.

(10) Patent No.: US 9,695,671 B2
(45) Date of Patent: Jul. 4, 2017

(54) METHOD AND SYSTEM FOR PLUGGING A WELL AND USE OF EXPLOSIVE CHARGES IN PLUGGING WELLS

(71) Applicant: Hydra PandA AS, Tananger (NO)

(72) Inventors: Morten Myhre, Tananger (NO); Arne Gunnar Larsen, Sandnes (NO); Roy Inge Jensen, Stavanger (NO); Patrick Andersen, Hafrsfjord (NO); Erlend Engelsgjerd, Tananger (NO); Markus Iuell, Tananger (NO); Arnt Olav Dahl, Randaberg (NO); Arnold Ostvold, Stavanger (NO)

(73) Assignee: Hydra PandA AS, Tananger (NO)

( * ) Notice: Subject to any disclaimer, the term of this patent is extended or adjusted under 35 U.S.C. 154(b) by 0 days.

(21) Appl. No.: 14/770,675

(22) PCT Filed: Mar. 12, 2014

(86) PCT No.: PCT/NO2014/050034
§ 371 (c)(1),
(2) Date: Aug. 26, 2015

(87) PCT Pub. No.: WO2014/148913
PCT Pub. Date: Sep. 25, 2014

(65) Prior Publication Data

US 2016/0010423 A1 Jan. 14, 2016

(30) Foreign Application Priority Data

Mar. 20, 2013 (NO) ..... 20130409

(51) Int. Cl.
*E21B 43/116* (2006.01)
*E21B 29/02* (2006.01)
(Continued)

(52) U.S. Cl.
CPC ..... *E21B 33/13* (2013.01); *E21B 29/002* (2013.01); *E21B 29/02* (2013.01); *E21B 33/134* (2013.01); *E21B 37/00* (2013.01); *E21B 43/117* (2013.01)

(58) Field of Classification Search
CPC ..... E21B 43/116; E21B 43/117; E21B 29/02; E21B 29/002; E21B 23/04
See application file for complete search history.

(56) References Cited

U.S. PATENT DOCUMENTS 2,591,807 A 4/1952 Greene
4,564,226 A * 1/1986 Doherty, Jr. ..... B21D 39/042 228/107
(Continued)

FOREIGN PATENT DOCUMENTS

NO 20120277 A 9/2013
WO 2012096580 A1 7/2012
WO 2012128644 A2 9/2012

OTHER PUBLICATIONS

International Preliminary Report on Patentability for PCT/NO2014/050034 dated Mar. 25, 2015.
(Continued)

*Primary Examiner* — Zakiya W Bates
(74) *Attorney, Agent, or Firm* — Andrus Intellectual Property Law, LLP

(57) ABSTRACT

A method is for plugging a well wherein the well, at least along a longitudinal section to be plugged, is provided with one or more pipe bodies forming a radial boundary between the well and a surrounding formation. The method includes (D), lowering a flow-through string into the well and, by the flow-through string, supplying a fluidized plugging material along the longitudinal section in the well, and at least within the innermost of said one or more pipe bodies in the well. The method, before step (D), also comprises (A), lowering
(Continued)

one or more explosive charges into the well and onto the longitudinal section to be plugged, and detonating one or more of said explosive charges so as to extend the diameter of one or more of said pipe bodies at one or more places along the longitudinal section to be plugged. A system is for plugging a well.

29 Claims, 9 Drawing Sheets

(51) Int. Cl.

| | |
|---|---|
| ***E21B 33/13*** | (2006.01) |
| ***E21B 33/134*** | (2006.01) |
| ***E21B 29/00*** | (2006.01) |
| ***E21B 37/00*** | (2006.01) |
| ***E21B 43/117*** | (2006.01) |

(56) References Cited

U.S. PATENT DOCUMENTS 5,022,148 A * 6/1991 Feldstein ..... B21D 26/08
228/108
6,533,040 B2 * 3/2003 Gondouin ..... E21B 7/065
166/380

OTHER PUBLICATIONS

International Search Report and Written Opinion for PCT/NO2014/050034 dated Jun. 18, 2014.

* cited by examiner

METHOD AND SYSTEM FOR PLUGGING A WELL AND USE OF EXPLOSIVE CHARGES IN PLUGGING WELLS

CROSS-REFERENCE TO RELATED APPLICATIONS

This application is the U.S. national stage application of International Application PCT/NO2014/050034, filed Mar. 12, 2014, which international application was published on Sep. 25, 2014, as International Publication WO2014/148913 in the English language. The international application is incorporated herein by reference, in entirety. The international application claims priority to Norwegian Patent Application No. 20130409, filed Mar. 20, 2013, which is incorporated herein by reference, in entirety.

FIELD

The present invention concerns a method for plugging a well. More specifically, the invention concerns a method for plugging a well via use of explosive charges, among other things. The invention also concerns a system for plugging a well.

The present invention may prove suitable when used for permanent plugging, often referred to as Plugging and Abandonment (P and A), of wells. It may possibly concern wells having been used in context of exploring for, or recovery of, hydrocarbons, however the invention is not restricted thereto. The invention may also be used in context of plugging other types of wells, for example geothermal wells, water wells, injection wells and similar.

BACKGROUND

Upon shutting down subterranean wells, stringent requirements are set with respect to barriers that are to prevent unwanted leakage of well fluids to the surroundings. A fluid-tight plug capable of withstanding continuous exposure to high pressure, high temperature, large forces and aggressive chemicals, must be set across the entire cross section of the well. Before being able to set the plug, different pipe bodies located in the well within the area where the plug is to be set, possibly may have been removed by virtue of mechanical cutting (so-called section milling). This process is very time-consuming, both due to the mechanical cutting and due to the subsequent removal of milled steel. It has proven difficult to ensure good adhesion and homogeneity of the plugging material, which usually is cement, both due to old, precipitated mud and due to remnants of milled steel pipes located in the well. The density and the stability of the plug may thus be impaired.

Patent publication WO 2012096580 describes a solution to this problem, and by virtue of pipe bodies in the well first being perforated using a perforation tool, for example a perforation gun. Then the well is flushed/purged by means of a washing tool before being plugged by means of a fluidized plugging material, for example hardening cement. Both with respect to the washing fluid and the fluidized plugging material, the perforations function as a passage between the inside and the outside of the pipe bodies.

Further, and in order to ensure a further improved density and homogeneity of the plug, patent publication WO 2012128644 describes an apparatus for improved displacement and distribution of the fluidized plugging material in the well.

In Norwegian patent application 20120277, a method and an apparatus for combined cleaning and plugging of a well is described. The method and apparatus are particularly suitable for use in wells provided with two or more substantially concentrically disposed pipe bodies in the longitudinal section to be plugged.

SUMMARY

A disadvantage of plugging according to the prior art, including prior art in accordance with the above-mentioned patent publications, is that it may still be difficult to form a good base for the fluidized plugging material, particularly in annuli between different pipe bodies in the well. Oftentimes the annuli are filled completely or partially with old, precipitated mud having a varying density. Owing to an insufficient base, a danger therefore exists in that the fluidized plugging material may sag downward in the well, thereby not forming a sufficiently good plug in the well.

A need also exists in the industry for alternative methods and/or means for plugging pipe bodies and annuli in a well.

The object of the invention is to remedy or to reduce at least one of the disadvantages of the prior art, or at least to provide a useful alternative to the prior art.

The object is achieved by virtue of features disclosed in the following description and in the subsequent claims.

In a first aspect, the invention concerns a method for plugging a well, wherein the well, at least along a longitudinal section to be plugged, is provided with one or more pipe bodies forming a radial boundary between the well and a surrounding formation, and wherein the method comprises the following steps:

(D) lowering a flow-through string into the well and, by means of the flow-through string, supplying a fluidized plugging material along the longitudinal section in the well, and at least within the innermost of said one or more pipe bodies in the well, characterized in that the method, before step (D), also comprises the following steps:

(A) lowering one or more explosive charges into the well and onto the longitudinal section to be plugged, and detonating one or more of said explosive charges so as to extend the diameter of one or more of said pipe bodies at one or more places along the longitudinal section to be plugged.

The method may possibly comprise an optional step (B) and (C), as described below.

In context of the method, a plug base is typically used in the innermost of said one or more pipe bodies in the well, wherein the plug base is disposed in a position underlying the longitudinal section to be plugged. The plug base may be set in vicinity of the longitudinal section to be plugged, or the plug base may be set farther down in the well. The plug base may be a sealing element of a type known per se, for example a mechanical plug. It is also conceivable that the innermost pipe body has already been partially filled with cement or the like, or possibly is provided with a suitable sealing element, below the longitudinal section to be plugged. This will not be discussed in further detail given that such plug bases are considered to be within the realm of the skilled person and will be adapted and used, by the skilled person, as deemed appropriate in the particular situation.

Detonation of one or more explosive charges so as to expand the diameter of one or more pipe bodies in the well, may cause one or more annuli between and/or outside said one or more pipe bodies to be closed completely or to be contracted partially, or at least cause a buckle to arise in the annulus.

Should such an annulus be closed completely through expansion of the associated pipe body, this may constitute, by itself, a fully satisfactory sealing and plugging of the annulus. This, for example, may be applicable for sealing an annulus located between a pipe body and a surrounding, subterranean formation. In this case, it will be necessary only to fill a fluidized plugging material in the very pipe body, and along said longitudinal section in the well, in order to form a fluid-tight plug across the entire cross section of the well. The same may apply if the longitudinal section of the well comprises several more or less concentric annuli capable of being sealed, in this manner, through expansion of the diameters of the respective pipe bodies within the longitudinal section.

In a first embodiment, the method may further comprise, after step (A), the following steps:

(B) lowering a cutting tool into the well and onto the longitudinal section to be plugged and, by means of the cutting tool, forming holes in one or more of said one or more pipe bodies; and further in step (D), allowing the fluidized plugging material to flow through the holes formed so as to fill both the inside and the outside of said one or more pipe bodies.

This embodiment variant renders possible to introduce a fluidized plugging material in one or more annuli within the longitudinal section of the well in those cases where this is considered to be appropriate or necessary. Given that precipitated drilling mud, which may be located in said one or more annuli, is capable of being compacted and/or displaced, changes in said one or more annuli may provide a better base for the fluidized plugging material to be used for closing the well.

In one embodiment, and in step (B), the cutting tool may be a perforation tool. This, for example, may be a perforating gun of a type known per se. Alternatively, the cutting tool may be a severing tool or another milling cutter, both being types known per se. In one embodiment, the cutting tool may be left behind in the well upon having completed the cutting operation.

In a further variant of said first embodiment, the method may further comprise, after step (B) and before step (D), the following steps:

(C) lowering, on the flow-through string, a flushing tool into the well and onto the longitudinal section and, by means of the flushing tool, cleaning the well along the longitudinal section, and both at the inside and the outside of said one or more pipe bodies. Cleaning the well prior to plugging will provide better adhesion and less contamination of the plugging material.

For the latter embodiment variant, step (C) in the method may comprise using a flushing tool formed with one or more outlets angled non-perpendicularly with respect to a longitudinal axis of the flushing tool. For example, the flushing tool may be of a type as described in the above-mentioned Norwegian patent application 20120277. This type of flushing tool may be particularly appropriate for use in wells where the longitudinal section to be plugged is provided with two or more of substantially concentrically disposed pipe bodies.

The method may further comprise at least one of rotating and moving the flushing tool in a reciprocating motion during the flushing. The motion/rotation may result in a more thorough cleaning of the well and, thus, in a further improved adhesion and less pollution of the fluidized plugging material.

In a further variant of said first embodiment, the method may further comprise, after step (D), the following steps:

(E) by means of a displacement apparatus, further displacing and distributing the fluidized plugging material in the well along the longitudinal section, and both at the inside and the outside of said one or more pipe bodies.

For example, the displacement apparatus may be a rotating and/or reciprocating apparatus having blades forcing the fluidized plugging material through the holes in said one or more pipe bodies and out into the annulus/annuli at the outside. The blades may be flexible, whereby the displacement apparatus functions almost like a spatula. An example of such a displacement apparatus is described in the above-mentioned patent publication WO 2012128644.

Further, and before step (A), the method may further comprise cutting one or more of said one or more pipe bodies around the entire circumference thereof. This may prove advantageous in order to avoid tension in said one or more pipe bodies upon detonation of the explosive charges. For example, the cutting may be carried out by means of a severing tool or another milling cutter, and this may be carried out within and/or outside the longitudinal section where the plug is to be set. In a well where said one or more pipe bodies have been put into tension, severing said one or more pipe bodies is not necessary.

For example, the fluidized plugging material may comprise cement, a particulate mass or a combination thereof.

In one embodiment of the method, the explosive charge may comprise an explosive, nitrated organic compound. The compound may be of a type known per se. For example, the explosive charge may comprise the explosive C4. The amount of explosive used in each explosive charge, as well as the number of explosive charges, may vary from well to well. This will depend, among other things, on the number of pipe bodies, the dimension of the pipe bodies/pipe body, the thickness of the pipe bodies/pipe body, and on the density and amount of the precipitated drilling mud in the annulus/annuli outside the pipe body/the pipe bodies. A concrete example will be given in the following description whilst referring to the accompanying figures. In an alternative embodiment, the explosive charge may comprise an explosive, inorganic compound.

In one embodiment, step (A) of the method may comprise placing the explosive charge uncentralized within the innermost of said one or more pipe bodies. By placing the charge uncentralized within the innermost pipe body, it is possible to achieve a better control of the explosion by virtue of bringing out more of the forces at one side of the pipe body.

In one embodiment of the method, said one or more explosive charges may be lowered into the well on a flow-through string, such as a drill string or a coiled tubing string. By so doing, it will be possible to pressure-activate the explosive charges, either by virtue of a total pressure or by virtue of a pressure difference, as known to a skilled person.

In an alternative method, said one or more explosive charges may be lowered into the well on a wireline. This will render electric detonation possible.

In a second aspect, the invention concerns a system for plugging a well, wherein the well, at least along a longitudinal section to be plugged, is provided with one or more pipe bodies forming a radial boundary between the well and a surrounding formation, wherein the system comprises:

a flow-through string structured in a manner allowing it to be lowered into the well and onto the longitudinal section to be plugged;

a fluidized plugging material structured in a manner allowing it to flow through the flow-through string and out into the well along the longitudinal section, and at least into the innermost of said one or more pipe bodies in the well, characterized in that the system further comprises:

one or more explosive charges structured in a manner allowing them to be lowered into the well and onto the longitudinal section to be plugged, and also structured in a manner allowing them to be detonated in the well so as to extend the diameter of one or more of said pipe bodies at one or more places along the longitudinal section to be plugged.

In a first embodiment, the system may comprise a cutting tool structured in a manner allowing it to be lowered into the well and onto the longitudinal section to be plugged, and also structured in a manner allowing it to form holes in one or more of said one or more pipe bodies, whereby the system allows the fluidized plugging material to flow through the holes formed so as to fill both the inside and the outside of said one or more pipe bodies. In this context, reference is made to the above comments to the method concerning such a cutting tool.

According to this first embodiment, the system may further comprise a flushing tool structured in a manner allowing it to be lowered into the well on the flow-through string and to clean both the inside and the outside of said one or more pipe bodies along the longitudinal section to be plugged. Also here, reference is made to the above comments to the method concerning such a flushing tool.

The flushing tool may be formed with one or more outlets angled non-perpendicularly with respect to a longitudinal axis of the flushing tool. The advantage thereof is described above.

According to the first embodiment, the system may further comprise a displacement apparatus structured in a manner allowing it to be lowered into the well so as to further displace and distribute the fluidized plugging material on the inside and the outside of said one or more pipe bodies, as described above.

In a third aspect, the invention concerns a use of one or more explosive charges for extending the diameter of one or more pipe bodies in a well in context of plugging the well.

BRIEF DESCRIPTION OF THE DRAWINGS

Hereinafter, an example of an embodiment of the invention is described and depicted in the accompanying drawings, wherein.

DETAILED DESCRIPTION OF THE DRAWINGS

Figure 1:
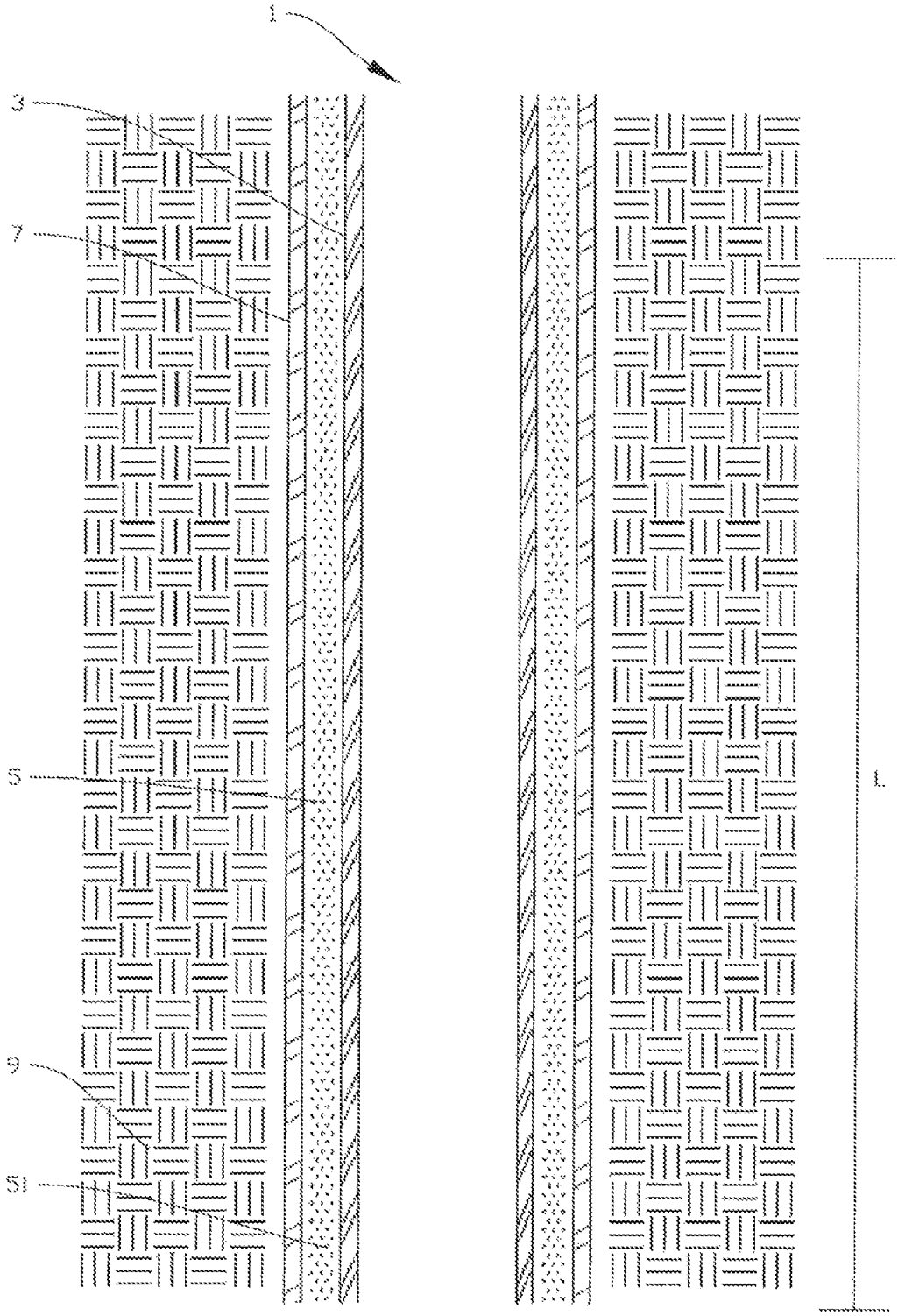
FIG. 1 shows a well, as viewed from the side, used in context of the present invention.

Hereinafter, reference numeral 1 denotes a well as used in context of the present invention. The figures are shown schematically and very simplified, and elements not being central to the invention may be omitted from the figures.

FIG. 1 shows a well 1 to be closed via plugging. The well 1 is provided with two pipe bodies 3, 7 in the form of an inner casing 3 and an outer casing 7. The casings 3, 7 form a radial boundary of the well 1 towards a surrounding formation 9, at least along a longitudinal section L to be plugged. An annulus 5 between the two casings 3, 7 is filled with viscous, precipitated drilling mud 51.

Figure 2:
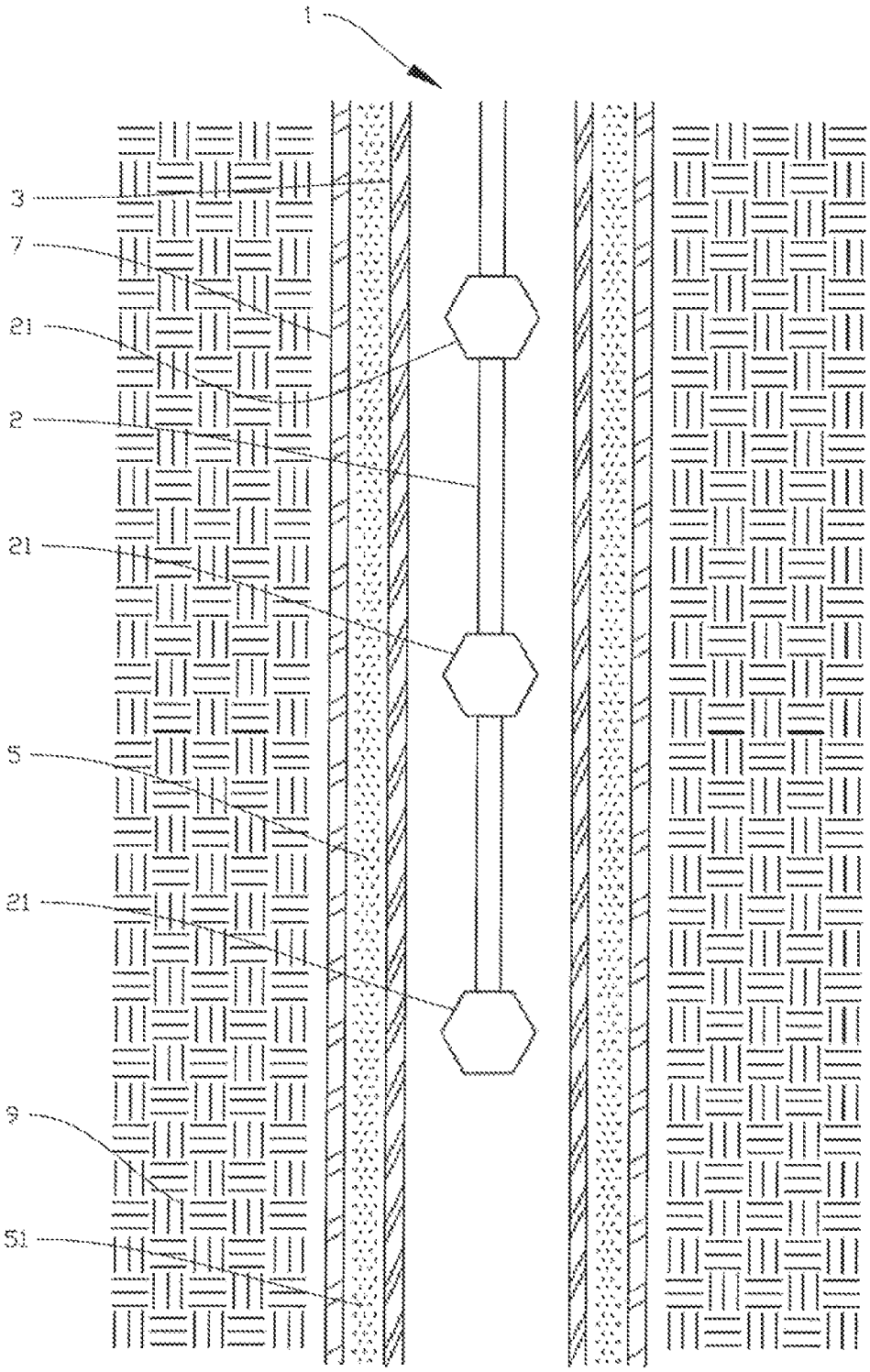
FIG. 2 shows the well, as viewed from the side, after having lowered explosive charges into the well and whilst being ready to be detonated.

In FIG. 2, the well 1 is shown after having lowered a plurality of explosive charges 21 into the well 1 on a lower part of a string 2. The explosive charges 21 are calibrated to the well 1 in order to allow at least the innermost casing 3 to be expanded so as to close or contract the annulus 5, or in order to allow the annulus 5 to buckle. In the exemplary embodiment shown, the casings 3, 7 are 7 inches and 9⅝ inches in diameter, respectively, and each of the explosive charges 21 comprises the explosive C4 in the order of 1.2 kg per 50 cm of the casings 3, 7.

Figure 3:
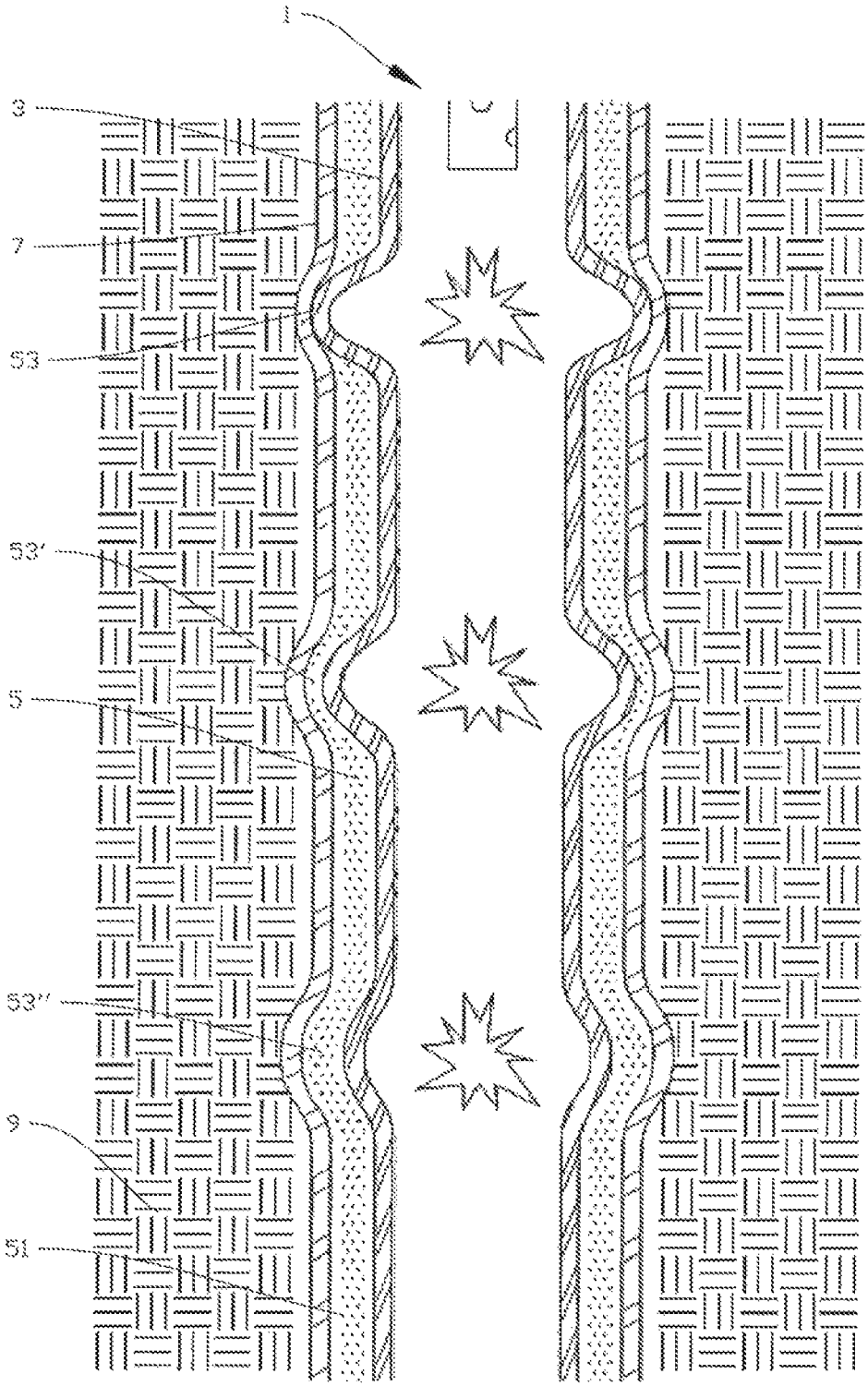
FIG. 3 shows the well, as viewed from the side, after having detonated the explosive charges.

FIG. 3 shows the well after having detonated the explosive charges 21 in series from the top to the bottom. The uppermost explosive charge 21 has produced a closure 53 in the annulus 5. Den middle explosive charge 21 has produced a contraction 53' in the annulus 5, whereas the lowermost explosive charge 21 has produced a buckle 53" in the annulus 5. The explosive charges 21 have caused compaction and displacement of the precipitated drilling mud 51 so as to produce an improved base for subsequent filling of a fluidized plugging material 4, see FIGS. 8 and 9.

Figure 4:
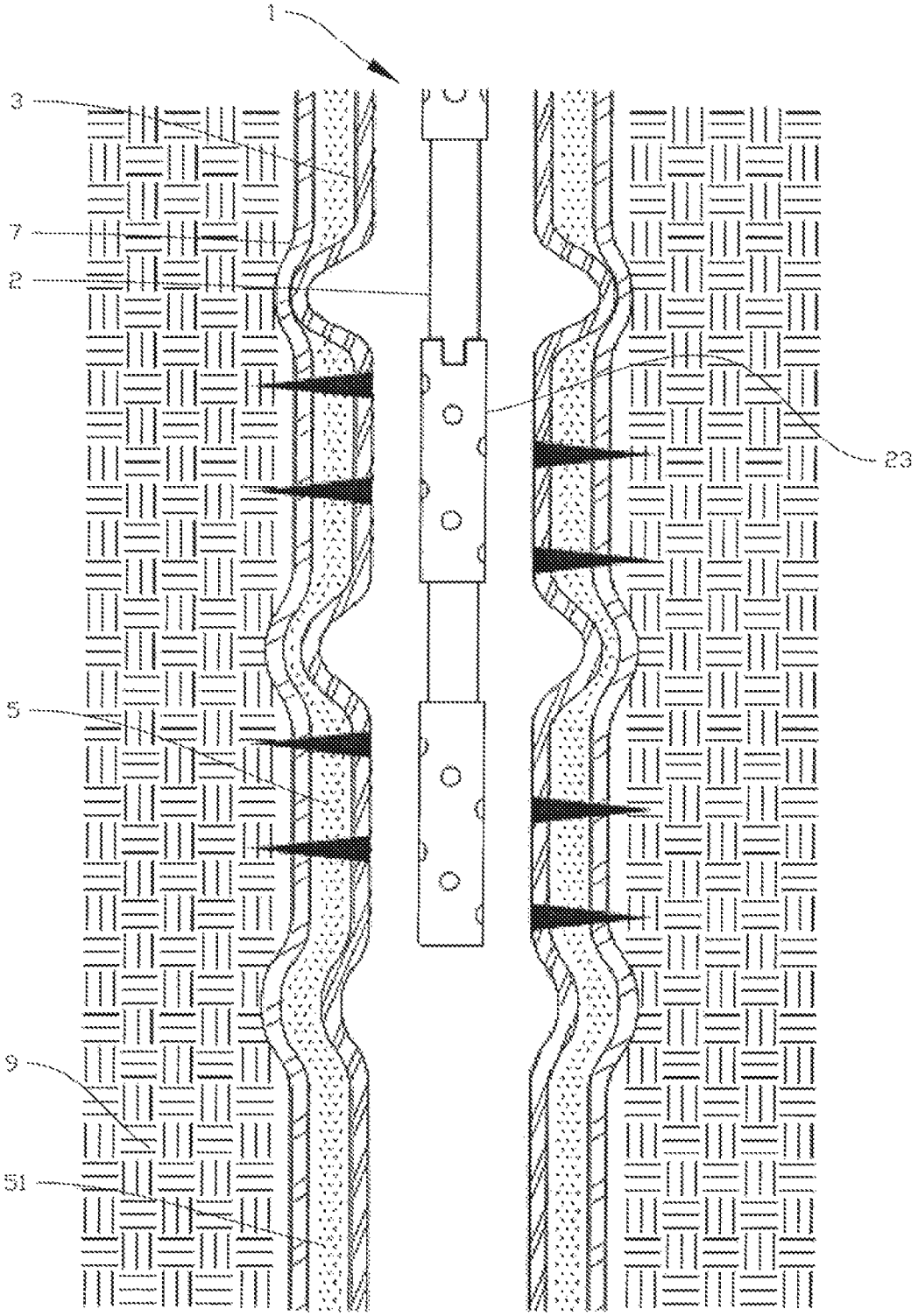
FIG. 4 shows the well, as viewed from the side, whilst a perforation tool is being fired.

In FIG. 4, the well 1 is shown whilst a perforating gun 23 is being fired. In the exemplary embodiment shown, the perforating gun 23 is attached to the same string 2 as that of the previously fired explosive charges 21.

Figure 5:
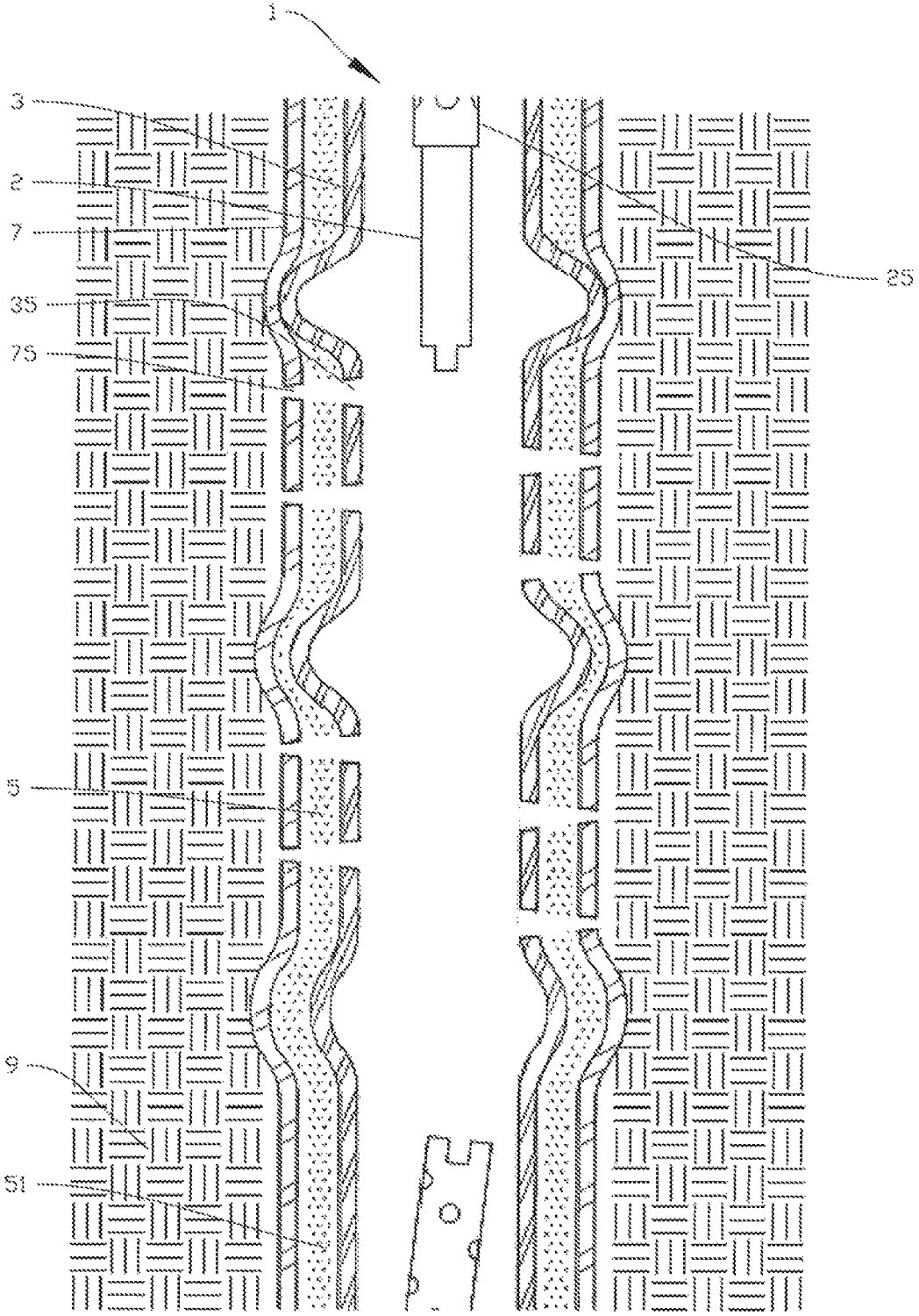
FIG. 5 shows the well, as viewed from the side, after having fired the perforation tool and being dropped down into the well, and whilst lowering a flushing tool into the well.

FIG. 5 shows the well 1 after having released the perforating gun 23 from the string 2 and being dropped down into the well 1. A plurality of perforations 35, 75 has been formed in the casings 5, 7. The upper part of the figure also shows a lower part of a flushing tool 25 attached, in the exemplary embodiment shown, to the same string 2 as the perforating gun 23 was attached to before being released therefrom. The string 2 is of a flow-though type.

Figure 6:
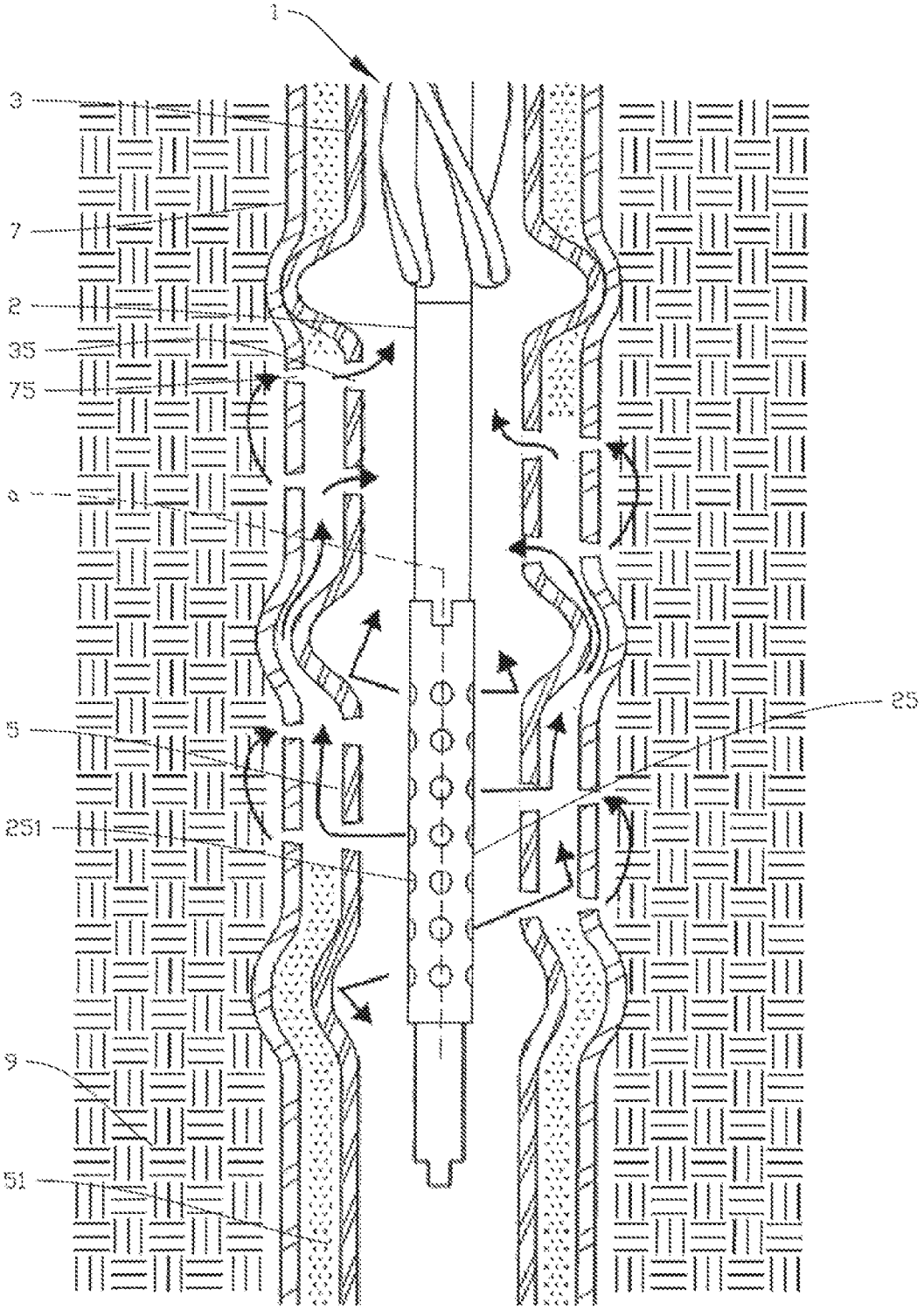
FIG. 6 shows the well, as viewed from the side, whilst the flushing tool is flushing.

In FIG. 6, the well 1 is shown whilst the flushing is taking place. The flushing tool 25 is formed with a plurality of outlets 251, wherein at least some of the outlets 251 are angled non-perpendicularly with respect to a longitudinal axis (a) of the flushing tool. The discharge direction of the fluid used during the flushing is depicted with downstream-directed arrows in the figure. The flushing fluid flows through the perforations 35, 75 so as to clean both the inside and the outside of the casings 3, 7.

Figure 7:
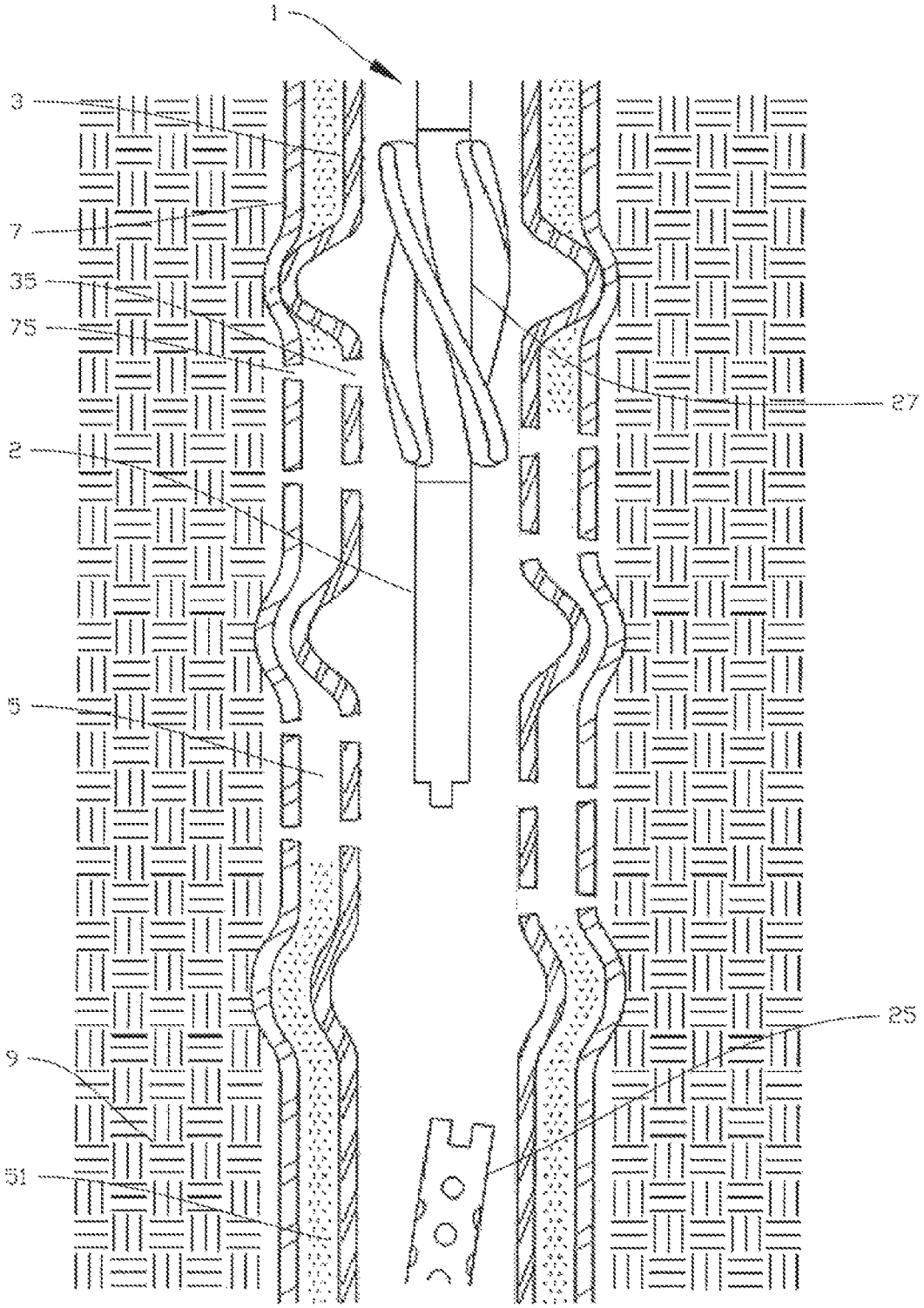
FIG. 7 shows the well, as viewed from the side, after having completed the flushing and having dropped the flushing tool down into the well, and whilst lowering a displacement apparatus into the well.

In FIG. 7, the well is shown after having released the flushing tool 25 from string 2 and being dropped down into the well 1, whilst a free end of the string 2 has been inserted into approximately the middle of the longitudinal section L.

Figure 8:
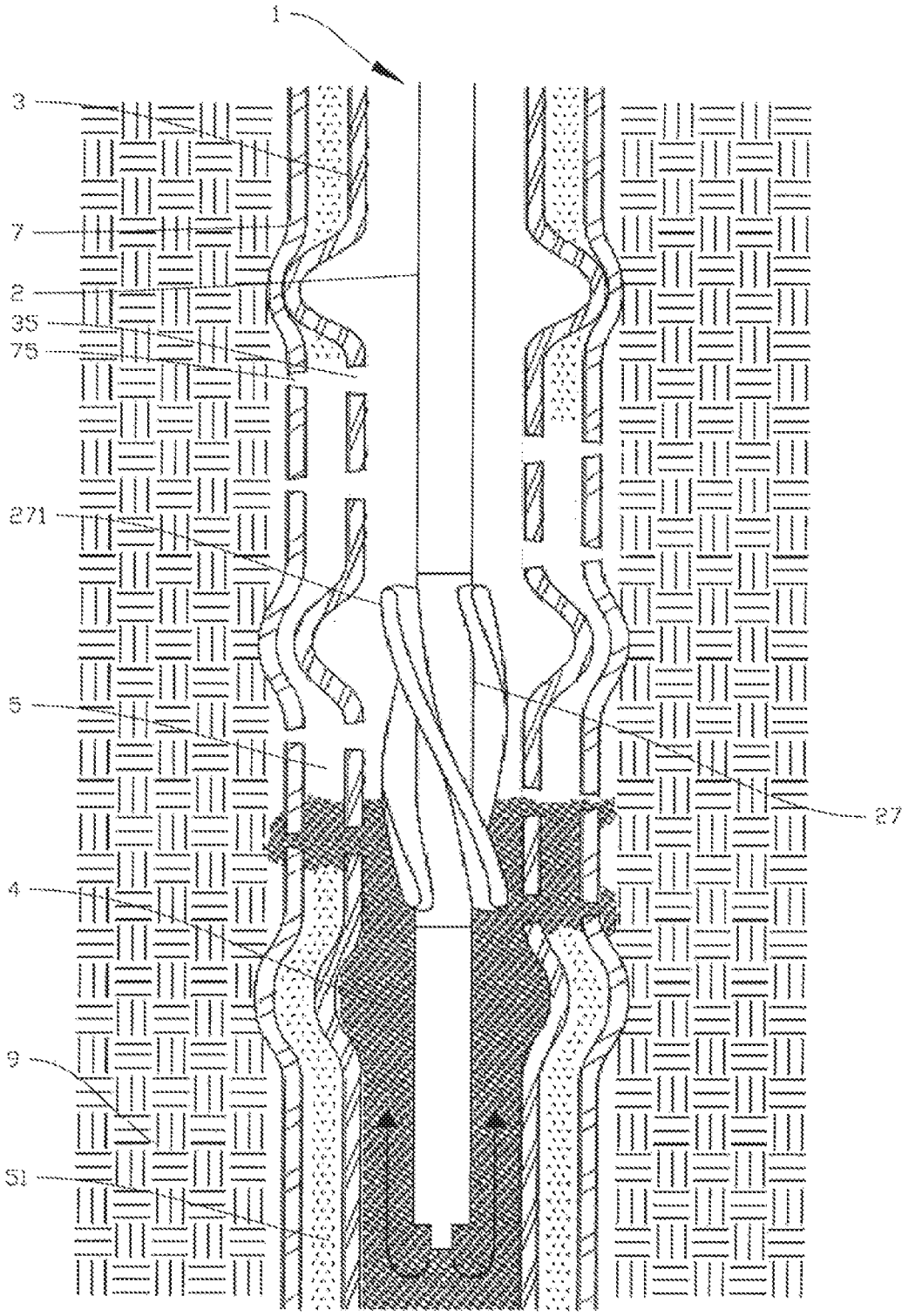
FIG. 8 shows the well, as viewed from the side, whilst a fluidized plugging material is being filled into the well, and whilst using said displacement apparatus to further displace and distribute the fluidized plugging material in the well.

FIG. 8 shows a fluidized plugging material 4 whilst flowing out through the free end of the string 2, via the perforations 35, 75 and out into the annulus 5. A displacement apparatus 27 provided with a plurality of flexible, obliquely inclined blades 271 are used to further displace and distribute the fluidized plugging material 4 in the well 1, thereby further improving the distribution of, and the homogeneity of, the fluidized plugging material 4.

Figure 9:
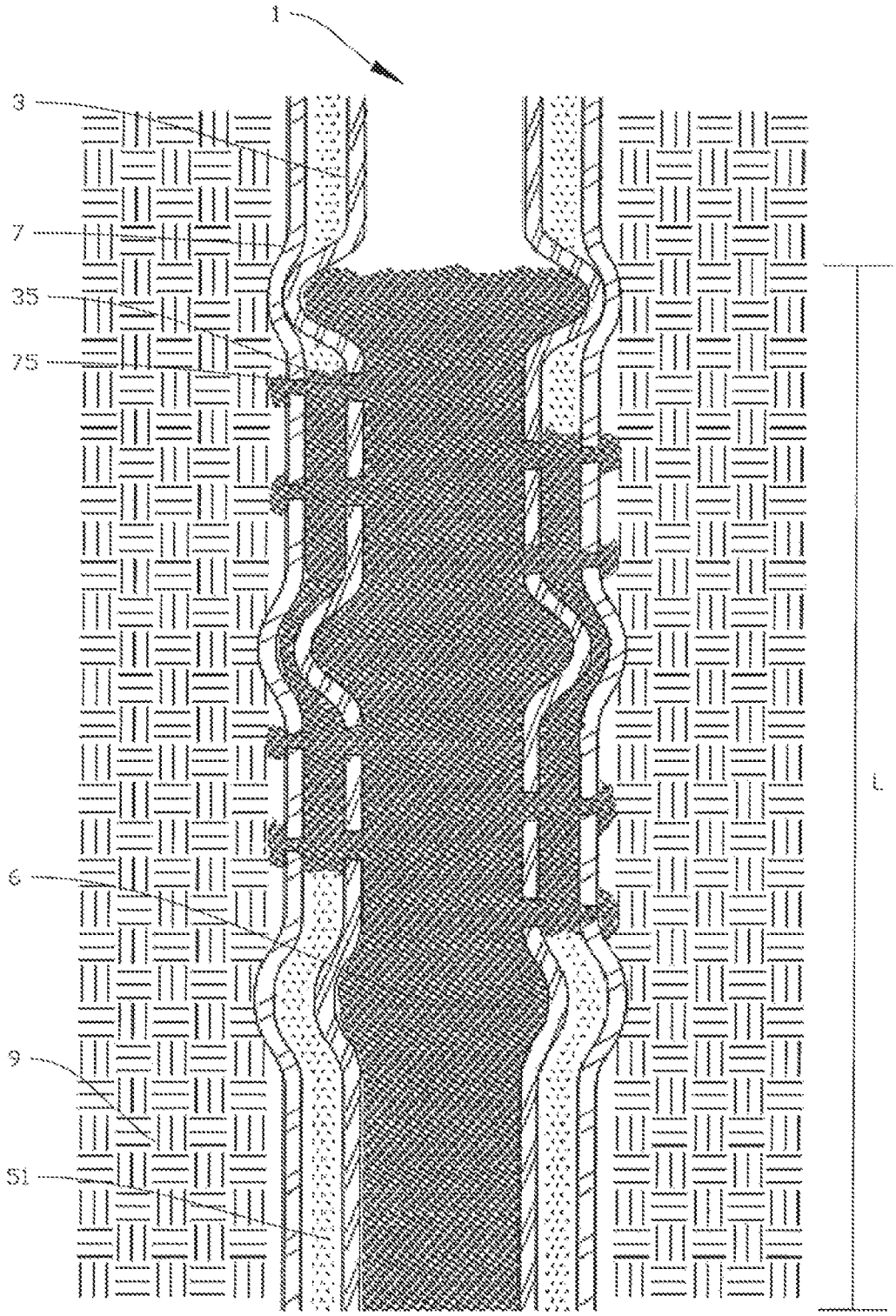
FIG. 9 shows the well, as viewed from the side, after having formed a plug from the fluidized plugging material.

In FIG. 9, the well 1 is shown after having been closed by means of a plug 6, wherein the plug 6 is formed through hardening of the fluidized plugging material 4 comprising, for example, a cement slurry.

In an alternative embodiment (not shown), both the said perforation and flushing may be omitted after having detonated the explosive charges 21. This assumes that at least one of the explosive charges 21 has produced a closure 53 in the annulus 5, and of the outer casing 7 towards the surrounding formation 9, as indicated by the upper explosive charge 21 in FIG. 3. In such a case, it may prove sufficient only to fill the fluidized plugging material 4 into the inner casing 3, and along the longitudinal section L, in order to obtain a fully satisfactory sealing and plugging of the well 1. Such an embodiment describes the simplest variant of the present invention.

The invention claimed is:

1. A method for plugging a well, wherein the well, at least along a longitudinal section to be plugged, is provided with one or more pipe bodies forming a radial boundary between the well and a surrounding formation, and wherein the method comprises the following steps:

(A) lowering one or more explosive charges into the well and onto the longitudinal section to be plugged, and detonating one or more of the explosive charges so as to extend the diameter of one or more of the pipe bodies at one or more places along the longitudinal section to be plugged, thereby forming at least one of a closure, a contraction and a buckle in one or more annuli located outside the one or more pipe bodies along the longitudinal section;

(B) lowering a cutting tool into the well and onto the longitudinal section to be plugged and, with the cutting tool, forming holes in one or more of the one or more pipe bodies;

(C) lowering, on a flow-through string, a flushing tool into the well and onto the longitudinal section and, with the flushing tool, cleaning the well along the longitudinal section, and both at the inside and the outside of the one or more pipe bodies; and (D) with the flow-through string, supplying a fluidized plugging material along the longitudinal section in the well, and at least within an innermost of the one or more pipe bodies in the well, and allowing the fluidized plugging material to flow through the holes formed so as to fill both the inside and the outside of the one or more pipe bodies, the at least one of a closure, a contraction and a buckle forming at least one base for the fluidized plugging material in the one or more annuli located outside the one or more pipe bodies along the longitudinal section.

2. The method according to claim 1, wherein the cutting tool, in step (B), is a perforation tool.

3. The method according to claim 1, wherein step (C) comprises using a flushing tool formed with one or more outlets angled non-perpendicularly with respect to a longitudinal axis of the flushing tool.

4. The method according to claim 1, wherein step (C) further comprises at least one of rotating and moving the flushing tool in a reciprocating motion during the cleaning.

5. The method according to claim 1, wherein the method, after step (D), further comprises:

(E) with a displacement apparatus, further displacing and distributing the fluidized plugging material in the well along the longitudinal section, and both at the inside and the outside of said one or more pipe bodies.

6. The method according to claim 1, wherein the method, before step (A), further comprises cutting one or more of the one or more pipe bodies around the entire circumference thereof.

7. The method according to claim 1, wherein the fluidized plugging material comprises cement.

8. The method according to claim 1, wherein the fluidized plugging material comprises a particulate mass.

9. The method according to claim 1, wherein the explosive charge comprises an explosive, nitrated organic compound.

10. The method according to claim 9, wherein the explosive charge comprises explosive C4.

11. The method according to claim 1, wherein step (A) comprises placing the explosive charge uncentralized within the innermost of the one or more pipe bodies.

12. The method according to claim 1, wherein the one or more explosive charges are lowered into the well on a flow-through string.

13. The method according to claim 1, wherein the one or more explosive charges are lowered into the well on a wireline.

14. A system for plugging a well, wherein the well, at least along a longitudinal section to be plugged, is provided with one or more pipe bodies forming a radial boundary between the well and a surrounding formation, wherein the system comprises:

a flow-through string for lowering into the well onto the longitudinal section to be plugged;

a fluidized plugging material for flowing through the flow-through string and out into the well along the longitudinal section, and at least into the innermost of the one or more pipe bodies in the well, wherein the system further comprises:

one or more explosive charges for lowering into the well onto the longitudinal section to be plugged in order to be detonated in the well so as to extend the diameter of one or more of the pipe bodies at one or more places along the longitudinal section to be plugged, thereby forming at least one of a closure, a contraction and a buckle in one or more annuli located outside the one or more pipe bodies along the longitudinal section.

15. The system according to claim 14, wherein the system comprises a cutting tool for lowering into the well onto the longitudinal section to be plugged in order to form holes in one or more of the one or more pipe bodies, whereby the system allows the fluidized plugging material to flow through the holes formed so as to fill both the inside and the outside of the one or more pipe bodies, the at least one of a closure, a contraction and a buckle forming at least one base for the fluidized plugging material in the one or more annuli located outside the one or more pipe bodies along the longitudinal section.

16. The system according to claim 15, wherein the system further comprises a flushing tool for lowering into the well on the flow-through string in order to clean both the inside and the outside of the one or more pipe bodies along the longitudinal section to be plugged.

17. The system according to claim 16, wherein the flushing tool is formed with one or more outlets angled non-perpendicularly with respect to a longitudinal axis of the flushing tool.

18. The system according to claim 15, wherein the system further comprises a displacement apparatus for lowering into the well in order to further displace and distribute the fluidized plugging material on the inside and the outside of the one or more pipe bodies.

19. A method for plugging a well, wherein the well, at least along a longitudinal section to be plugged, is provided with one or more pipe bodies forming a radial boundary between the well and a surrounding formation, and wherein the method comprises the following steps:

lowering one or more explosive charges into the well and onto the longitudinal section to be plugged, and detonating one or more of the explosive charges so as to extend the diameter of one or more of the pipe bodies at one or more places along the longitudinal section to be plugged, thereby forming at least one of a closure, a contraction and a buckle in one or more annuli located outside the one or more pipe bodies along the longitudinal section; and lowering a flow-through string into the well and, with the flow-through string, supplying a fluidized plugging material along the longitudinal section in the well, and at least within an innermost of the one or more pipe bodies in the well.

20. The method according to claim 19, wherein the method, before lowering the one or more explosive charges into the well, further comprises cutting one or more of the one or more pipe bodies around the entire circumference thereof.

21. The method according to claim 19, wherein the fluidized plugging material comprises cement.

22. The method according to claim 19, wherein the fluidized plugging material comprises a particulate mass.

23. The method according to claim 19, wherein the explosive charge comprises an explosive, nitrated organic compound.

24. The method according to claim 23, wherein the explosive charge comprises explosive C4.

25. The method according to claim 19, wherein the one or more explosive charges are lowered into the well on a flow-through string.

26. The method according to claim 19, wherein the one or more explosive charges are lowered into the well on a wireline.

27. A method for plugging a well, wherein the well, at least along a longitudinal section to be plugged, is provided with one or more pipe bodies forming a radial boundary between the well and a surrounding formation, and wherein the method comprises the following steps:

lowering one or more explosive charges into the well and onto the longitudinal section to be plugged, and detonating one or more of the explosive charges so as to extend the diameter of one or more of the pipe bodies at one or more places along the longitudinal section to be plugged, thereby forming at least one of a closure, a contraction and a buckle in one or more annuli located outside the one or more pipe bodies along the longitudinal section;

lowering a cutting tool into the well and onto the longitudinal section to be plugged and, with the cutting tool, forming holes in one or more of the one or more pipe bodies; and lowering a flow-through string into the well and, with the flow-through string, supplying a fluidized plugging material along the longitudinal section in the well, and at least within an innermost of the one or more pipe bodies in the well, and allowing the fluidized plugging material to flow through the holes formed so as to fill both the inside and the outside of the one or more pipe bodies, the at least one of a closure, a contraction and a buckle forming at least one base for the fluidized plugging material in the one or more annuli located outside the one or more pipe bodies along the longitudinal section.

28. The method according to claim 27, wherein the cutting tool is a perforation tool.

29. The method according to claim 27, wherein the method, after the step of supplying the fluidized plugging material in the well, further comprises the following step:

with a displacement apparatus, further displacing and distributing the fluidized plugging material in the well along the longitudinal section, and both at the inside and the outside of said one or more pipe bodies.

* * * * *